US008727725B1

(12) United States Patent
Liang

(10) Patent No.: US 8,727,725 B1
(45) Date of Patent: May 20, 2014

(54) TURBINE VANE WITH LEADING EDGE FILLET REGION COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 515 days.

(21) Appl. No.: 12/357,654

(22) Filed: Jan. 22, 2009

(51) Int. Cl.
*F01D 5/08* (2006.01)

(52) U.S. Cl.
USPC ..... 416/97 R; 415/115

(58) Field of Classification Search
USPC ..... 415/115, 191; 416/97 R
See application file for complete search history.

(56) References Cited

U.S. PATENT DOCUMENTS

| | | | | |
|---|---|---|---|---|
| 4,863,348 | A * | 9/1989 | Weinhold | 416/92 |
| 5,340,278 | A * | 8/1994 | Magowan | 416/96 R |
| 6,190,128 | B1 * | 2/2001 | Fukuno et al. | 416/96 R |
| 6,354,797 | B1 * | 3/2002 | Heyward et al. | 415/191 |
| 6,790,005 | B2 * | 9/2004 | Lee et al. | 416/97 R |
| 6,830,432 | B1 * | 12/2004 | Scott et al. | 416/97 R |
| 7,004,720 | B2 * | 2/2006 | Synnott et al. | 415/115 |
| 7,008,185 | B2 * | 3/2006 | Peterman et al. | 416/96 A |
| 7,097,417 | B2 * | 8/2006 | Liang | 415/115 |
| 7,217,096 | B2 * | 5/2007 | Lee | 416/97 R |
| 7,249,933 | B2 * | 7/2007 | Lee et al. | 416/97 R |
| 7,621,718 | B1 * | 11/2009 | Liang | 415/115 |
| 2001/0048878 | A1 * | 12/2001 | Willett et al. | 416/97 R |
| 2005/0175444 | A1 * | 8/2005 | Liang | 415/115 |
| 2006/0051209 | A1 * | 3/2006 | Lee et al. | 416/97 R |
| 2006/0127220 | A1 * | 6/2006 | Lee | 416/97 R |
| 2008/0085190 | A1 * | 4/2008 | Liang | 416/193 A |
| 2009/0208325 | A1 * | 8/2009 | Devore et al. | 415/116 |
| 2010/0310367 | A1 * | 12/2010 | Devore et al. | 416/1 |

* cited by examiner

*Primary Examiner* — Matthew Landau
*Assistant Examiner* — Joseph C Nicely
(74) *Attorney, Agent, or Firm* — John Ryznic

(57) ABSTRACT

A turbine vane for use in a gas turbine engine, the vane including an airfoil portion and an endwall in which fillets extend around the airfoil at the junction to the endwall. A row of film cooling holes that connects to a cooling air supply cavity on the outer side of the endwall and open into breakout holes that are located in the fillets discharge film cooling air into the fillet. The breakout holes extend around the leading edge in the fillet and extend along the pressure side fillet and the suction side fillet just past the leading edge region to discharge film cooling air into the fillets. The film cooling holes are straight holes and are aligned with the curvature of the fillet at the midpoint height of the fillet.

12 Claims, 5 Drawing Sheets

TURBINE VANE WITH LEADING EDGE FILLET REGION COOLING

BACKGROUND OF THE INVENTION

1. Field of the Invention

The present invention relates generally to a gas turbine engine, and more specifically to turbine vanes and the cooling of the leading edge fillet region.

2. Description of the Related Art Including Information Disclosed Under 37 CFR 1.97 and 1.98

In a typical combustion turbine engine, a variety of vortex flows are generated around airfoil elements within the turbine. FIG. 1 is a perspective view of a cut-away of several turbine airfoil portions 1 showing hot combustion fluid flow 3 around the airfoil portions 1. This is described and illustrated in U.S. Pat. No. 6,830,432 B1 issued to Scott et al on Dec. 14, 2004 and entitled COOLING OF COMBUSTION TURBINE AIRFOIL FILLETS. It is known that "horseshoe" vortices, including a pressure side vortex 4, and a suction side vortex 5, are formed when a hot combustion fluid flow 3 collides with the leading edges 6 of the airfoil portions 1. The vortices 4, 5 are formed according to the particular geometry of the airfoil portions 1, and the spacing between the airfoil portions 1 mounted on the platform 2. As the hot combustion fluid flow 3 splits into the pressure side vortex 4 and a suction side vortex 5, the vortices 4, 5 rotate in directions that sweep downward from the respective side of the airfoil portion 1 to the platform 2. On the pressure side 8 of the airfoil portions 1, the pressure side vortex 4 is the predominant vortex, sweeping downward as the pressure side vortex 4 passes by the airfoil portion 1. As shown, the pressure side vortex 4 crosses from the pressure side 8 of the airfoil portion 1 to the suction side 7 of an adjacent airfoil portion 1. In addition, the pressure side vortex 4 increases in strength and size as it crosses from the pressure side 8 to the suction side 7. Upon reaching the suction side 7, the pressure side vortex 4 is substantially stronger than the suction side vortex 5 and is spinning in a rotational direction opposite from the suction side vortex 5. On the suction side 7, the pressure side vortex 4 sweeps up from the platform 2 towards the airfoil portion 1. Consequently, because the pressure side vortex 4 is substantially stronger that the suction side vortex 5, the resultant, or combined flow of the two vortices 4, 5 along the suction side 7 is radially directed to sweep up from the platform 2 towards the airfoil portion 1.

A conventional approach to cooling fluid guide members, such as airfoils in combustion turbines, is to provide cooling fluid, such as high pressure cooling air from the intermediate or last stages of the turbine compressor, to a series of internal flow passages within the airfoil. In this manner, the mass flow of the cooling fluid moving through passages within the airfoil portion provides backside convective cooling to the material exposed to the hot combustion gas. In another cooling technique, film cooling of the exterior of the airfoil can be accomplished by providing a multitude of cooling holes in the airfoil portion to allow cooling fluid to pass from the interior of the airfoil to the exterior surface. The cooling fluid exiting the holes forms a cooling film, thereby insulating the airfoil from the hot combustion gas. While such techniques appear to be effective in cooling the airfoil region, little cooling is provided to the fillet region where the airfoil is joined to a mounting endwall. In a rotor blade, the flow forming surface extending on the sides of the airfoil and root is referred to as a platform. In a stator vane, an inner shroud and an outer shroud that forms the flow surfaces are referred to as endwalls.

The fillet region is important in controlling stresses where the airfoil is joined to the endwall. Although larger fillets can lower stresses at the joint, such as disclosed in U.S. Pat. No. 6,190,128, issued to Fukuno et al on Feb. 29, 2001 and entitled COOLED MOVING BLADE FOR GAS TURBINE the resulting larger mass of material is more difficult to cool through indirect means. Accordingly, prohibitively large amounts of cooling flow may need to be applied to the region of the fillet to provide sufficient cooling. If more cooling flow for film cooling is provided to the airfoil in an attempt to cool the fillet region, a disproportionate amount of cooling fluid may be diverted from the compressor system, reducing the efficiency of the engine and adversely affecting emissions. While forming holes in the fillet to provide film cooling directly to the fillet region would improve cooling in this region, it is not feasible to form holes in the fillet because of the resulting stress concentration that would be created in this highly stressed area.

Backside impingement cooling of the fillet region has been proposed in U.S. Pat. No. 6,398,486. However, this requires additional complexity, such as an impingement plate mounted within the airfoil portion. In addition, the airfoil portion walls in the fillet region are generally thicker, which greatly reduces the effectiveness of backside impingement cooling.

U.S. Pat. No. 6,830,432 B1 issued to Scott et al on Dec. 14, 2004 entitled COOLING OF COMBUSTION TURBINE AIRFOIL FILLETS discloses a row of fillet cooling holes positioned along the airfoil surface just above the fillet extending along the pressure side wall of the airfoil to direct a cooling film over the fillet. FIGS. 4 and 5 show the cooling flows for the Scott et al patent. The Scott et al patent does not disclose any cooling of the fillet in the leading edge region.

As the hot flow core gas enters the turbine with a boundary layer thickness and collides with the leading edge of the vane, the horseshoe vortex separates into a pressure side and suction side downward vortices. Initially, the pressure vortex sweeps downward and flows along the airfoil pressure side forward fillet region first. Then, due to hot flow channel pressure gradient from pressure side to suction side, the pressure side vortex migrates across the hot flow passage and end up at the suction side of the adjacent airfoil. As the pressure side vortex roll across the hot flow channel, the size and strength of the passage vortex becomes larger and stronger. Since the passage vortex is much stronger than the suction side vortex, the suction side vortex flow along the airfoil suction side fillet and acting as a counter vortex for the passage vortex. FIG. 1 shows the vortices formation for a boundary layer entering a turbine airfoil. As a result of these vortices flow phenomena, some of the hot core gas flow from the upper airfoil span is transferred toward close proximity to the end wall and thus creates a high heat transfer coefficient and high gas temperature region at the airfoil fillet region.

As shown in FIG. 1, the resulting forces drive the stagnated flow that occurs along the airfoil leading edge towards the region of lower pressure at the intersection of the airfoil and end wall. This secondary flow flows around the airfoil leading edge fillet and end wall region. This secondary flow then rolls away from the airfoil leading edge and flows upstream along the end wall against the hot core gas flow as seen in FIGS. 2 and 3. As a result, the stagnated flow forces acting on the hot core gas and radial transfer of hot core gas will flow from the upper airfoil span toward close proximity to the end wall and thus creates a high heat transfer coefficient and high gas temperature region at the intersection location.

Currently, injection of film cooling air at discrete locations along the horseshoe vortex region is used to provide the cooling for this region. However, there are many drawbacks for this type of film blowing injection cooling method. The high film effectiveness level is difficult to establish and maintain in the high turbulent environment and high pressure variation such as horseshoe vortex region. Film cooling is very sensitive to the pressure gradient. The mainstream pressure variation is very high at the horseshoe vortex location. The spacing between the discrete film cooling holes and areas immediately downstream of the spacing are exposed less or provide no film cooling air. Consequently, these areas are more susceptible to thermal degradation and over temperature. As a result of this, spalling of the TBC (thermal barrier coating) and cracking of the airfoil substrate will occur.

For the airfoil pressure side fillet region, cooling of the fillet region by means of conventional backside impingement cooling yields inefficient results due to the thickness of the airfoil fillet region. Drilling film cooling holes at the airfoil fillet to provide film cooling produces unacceptable stress by the film cooling holes. An alternative way of cooling the fillet region is by the injection of film cooling air at discrete locations along the airfoil peripheral and end wall into the vortex flow to create a film cooling layer for the fillet region. The film layer migration onto the airfoil fillet region is highly dependent on the secondary flow pressure gradient. For the airfoil pressure side and suction side downstream section, this film injection method provides a viable cooling approach. However, for the fillet region immediately downstream of the airfoil leading edge, where the mainstream or secondary pressure gradient is in the stream-wise direction, injection of film cooling air from the airfoil or end wall surface will not be able to migrate the cooling flow to the fillet region to create a film sub-boundary layer for cooling that particular section of the fillet. Also, drilling cooling holes through the fillet region will weaken the structure of the airfoil.

Accordingly, there is a need for improved cooling in the fillet regions of turbine guide members.

BRIEF SUMMARY OF THE INVENTION

It is an object of the present invention to provide for impingement cooling and film cooling of the leading edge fillet region of a turbine vane.

It is another object of the present invention to provide for a turbine stator vane with less thermal degradation and less over-temperature on the vane leading edge horseshoe region than in the cited prior art vanes.

It is another object of the present invention to provide for a turbine stator vane with fillet region cooling holes that do not open into the fillet that would weaken the structure of the airfoil.

The present invention is a stator vane with a row of compound angled film cooling holes drilled around the periphery of the airfoil leading edge fillet region within the vane endwall. The cooling air for the fillet region cooling is provided from the endwall cooling air supply cavity, and impinged onto the backside of the airfoil endwall first for the cooling of the airfoil endwall region. A portion of the spent cooling air is then fed through the compound angled film cooling holes from the post impingement cavity and discharged on the surface of the fillet. Subsequently, this spent cooling air will flow in the stream-wise direction to provide for a film cooling layer for the fillet region immediately downstream of the airfoil leading edge. Since the cooling hole is installed through the airfoil endwall and outside the fillet region only the film hole break out foot print is located on the fillet surface and thus the structural integrity of the airfoil fillet region is not compromised.

DETAILED DESCRIPTION OF THE INVENTION

Figure 1:
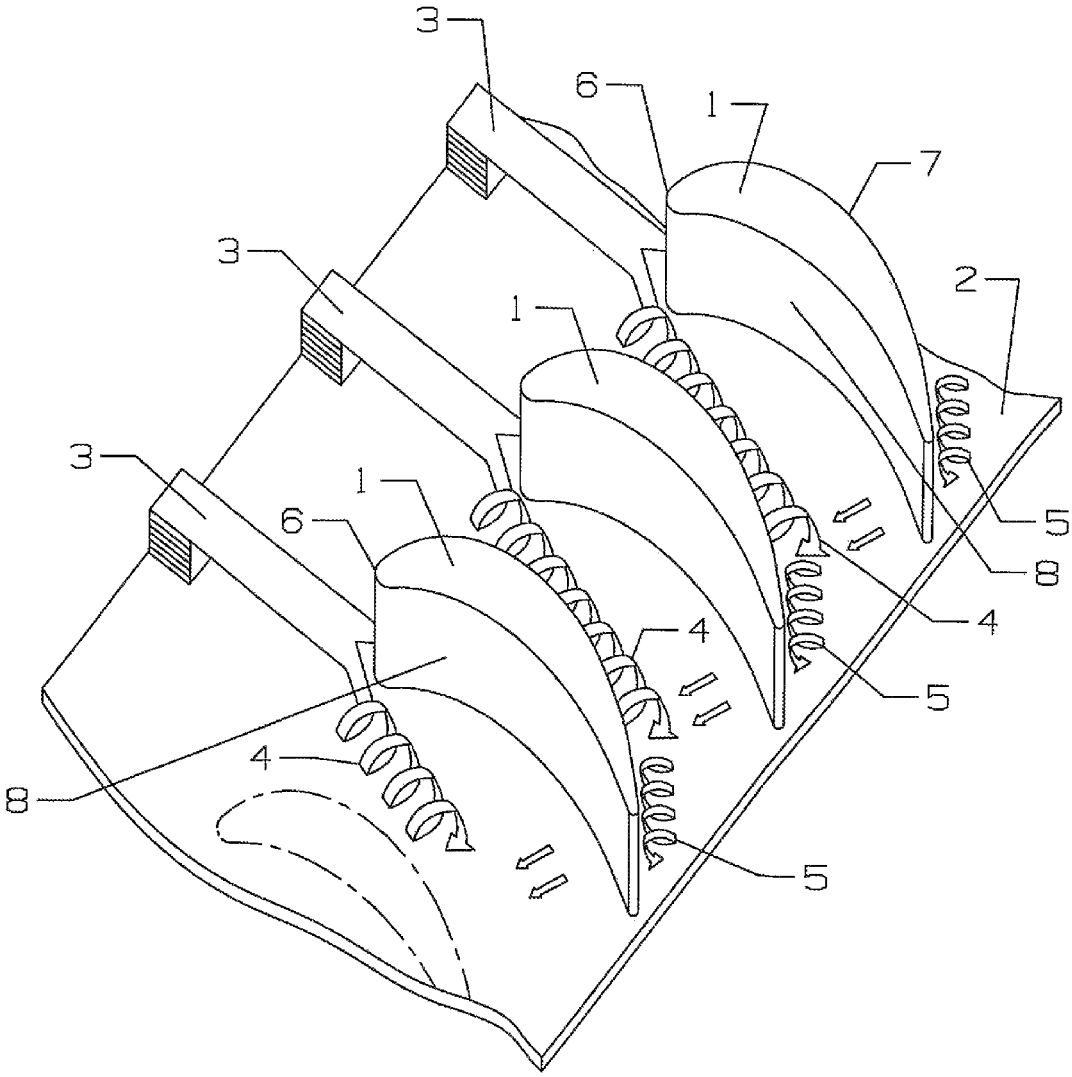
Fig 1 Prior Art
FIG. 1 shows a schematic view of a prior art turbine vane hot gas flow with a vortex flow formation.
Figure 2:
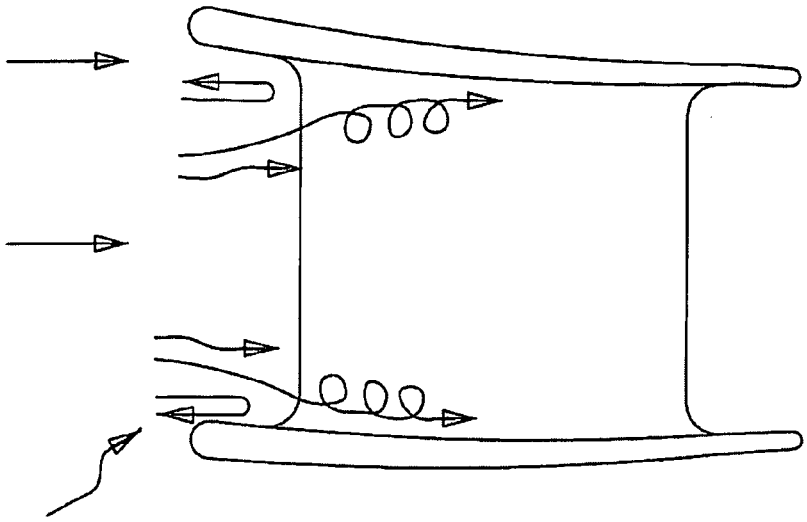
Fig 2 Prior Art
FIG. 2 shows a side view of the secondary flow direction of the hot gas flow of the prior art FIG. 1 turbine vane.
Figure 3:
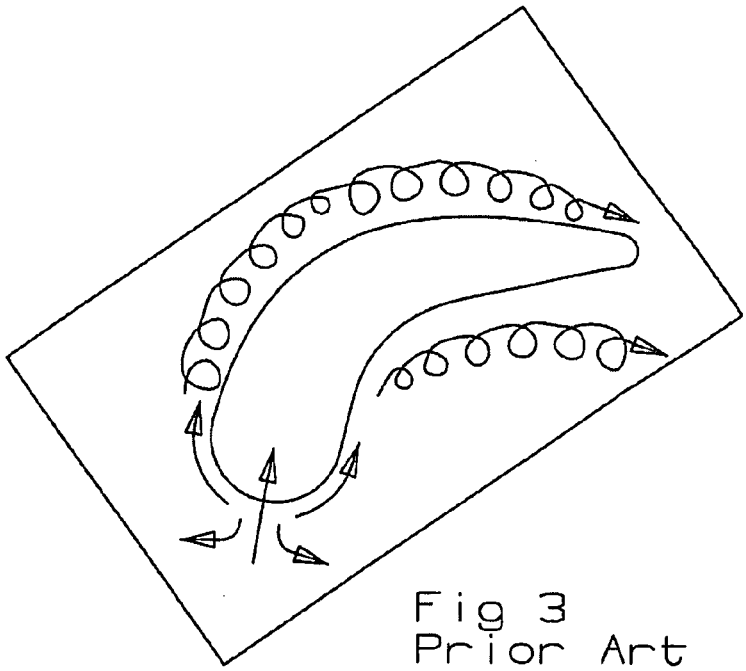
Fig 3 Prior Art
FIG. 3 shows a top view of the secondary flow direction of the hot gas flow of the prior art FIG. 1 turbine vane.
Figure 4:
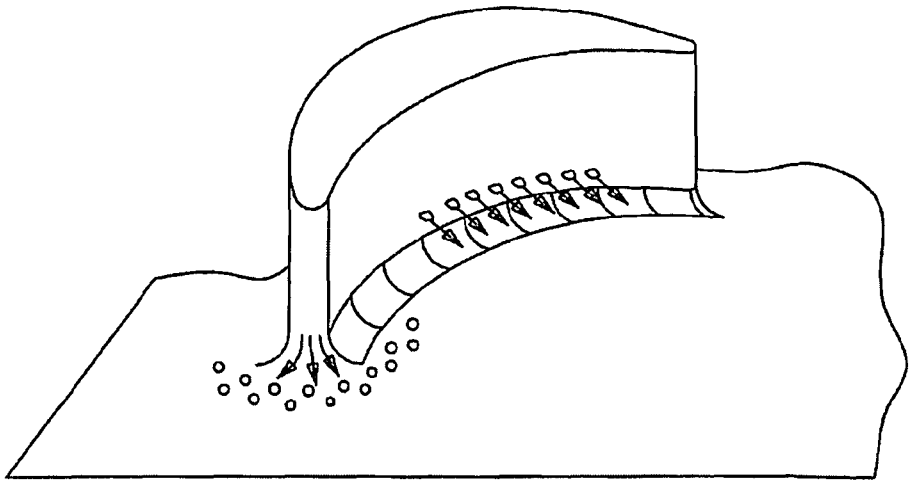
Fig 4 Prior Art
FIG. 4 shows a turbine vane of the prior art with pressure side and suction side fillet region cooling holes.
Figure 5:
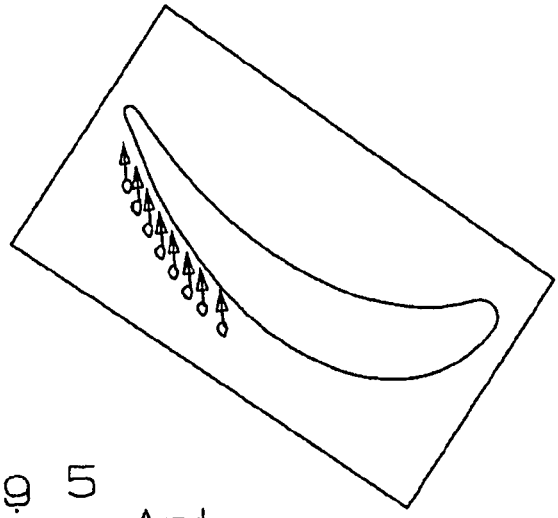
Fig 5 Prior Art
FIG. 5 shows a turbine vane of the prior art with suction side film cooling holes on the end wall.
Figure 6:
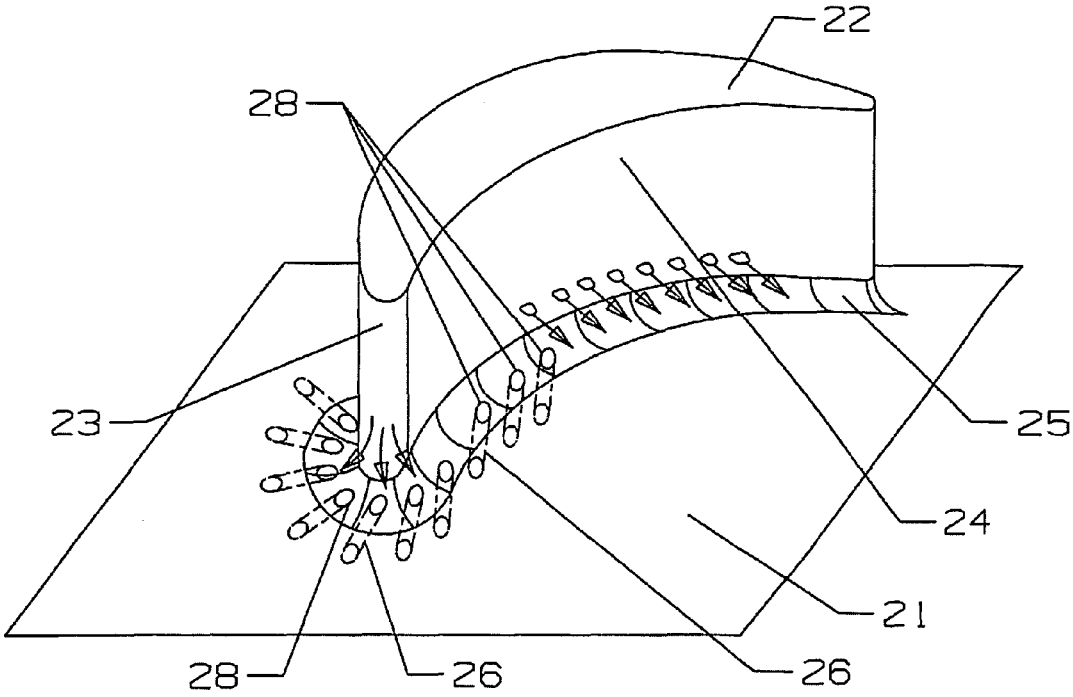
FIG. 6 shows a pressure side view of the fillet cooling arrangement for a turbine vane according to the present invention.
Figure 7:
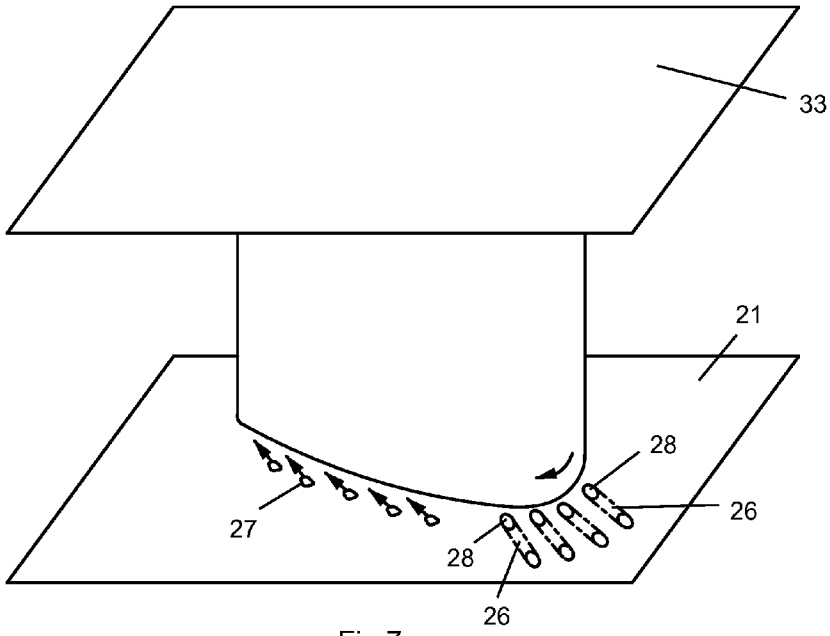
FIG. 7 shows a suction side view of the leading edge fillet cooling arrangement of the present invention.

The turbine stator vane of the present invention is shown in FIG. 6 and includes an endwall 21 with an airfoil 22 extending from it to an opposite endwall (not shown). The vane includes a leading edge 23 and a pressure side 24 shown in this figure. A fillet 25 extends around the airfoil in a transition between a flat surface of the endwall 21 and the airfoil 22. A row of cooling holes is located along the mid-chord region of the airfoil adjacent to the fillet 25 as seen in FIG. 6. The feature of the present invention is the compound angled cooling holes 26 that extend around the leading edge region of the airfoil and along the pressure side fillet and suction side fillet as seen in FIG. 6 on the pressure side and FIG. 7 on the suction side. FIG. 7 also shows a row of cooling holes 27 opening on the endwall surface adjacent to the mid-chord section of the airfoil on the suction side.

Figure 8:
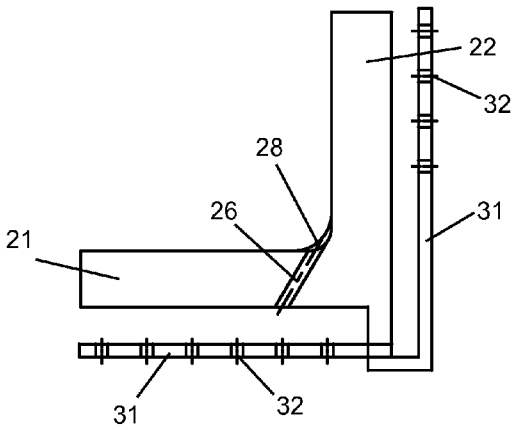
FIG. 8 shows a cross section side view of the leading edge fillet cooling circuit in the inner endwall of the present invention.
Figure 9:
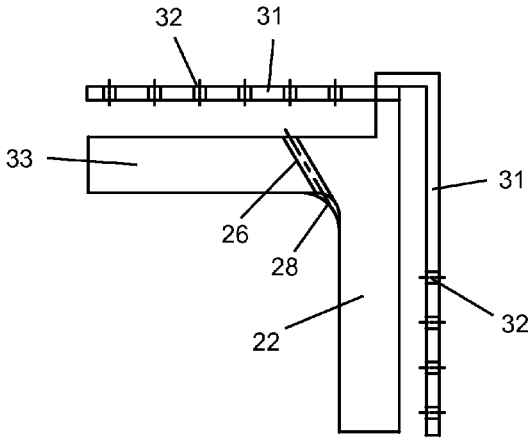
FIG. 9 shows a cross section side view of the leading edge fillet cooling circuit in the outer endwall of the present invention.

FIG. 8 shows a cross section side view through one of the compound angled holes 26 with the inner endwall 21 and the airfoil 22 in relation to the hole 26. The hole 26 connects the bottom surface of the endwall 21 and opens into the fillet to form a film hole breakout 28. The compound angled hole 26 is straight in the endwall 21. The angle of the compound angled hole 26 with respect to the endwall outer surface is around 45 degrees. Located adjacent to the endwall and the airfoil wall are impingement plates 31 with rows of impingement holes 32 positioned to provide impingement cooling for the inner surface of the endwall 21 and the backside surface of the vane airfoil wall. FIG. 9 shows the outer endwall 33 extending from the airfoil 22 with the compound angled hole 26 and the film breakout 28 in the fillet. Impingement plates 31 and impingement holes 32 are spaced around the outer endwall 33 as well.

Cooling air supplied to the endwall cooling air supply cavity passes through the impingement holes 32 in the impingement plates 31 to provide impingement cooling. Some of the spent cooling air then flows into the compound angled cooling holes 26 and into the film hole breakouts 28 and into the fillet region. The cooling air exiting the film holes breakouts 28 on the pressure side of the stagnation point will flow along the fillet toward the trailing edge, while the cooling air exiting the film holes breakouts 28 on the suction side of the stagnation point will flow along the fillet toward the trailing edge as seen by the arrows in FIGS. 6 and 7.

The turbine stator vane can be made using the investment casting process followed by machining of the film cooling holes and the breakout hole onto the fillet surface. The drilled holes can be EDM (electric discharge machining) machined or cut with a laser. The film holes opening into the fillet can be used in both the inner endwall and the outer endwall of the stator vane.

Major design features and advantages of this film cooling design are described below. The compound angled film hole provides film cooling along the airfoil leading edge fillet downstream region without drilling through the fillet section material. Film cooling holes installed in the endwall of the airfoil leading edge region provides convective cooling for the airfoil endwall and without inducing thermal gradient for the fillet region. The breakout of the cooling hole is located on the fillet surface and provides film cooling for the fillet region on the airfoil. The backside impingement cooling air provides backside impingement cooling for the endwall first and then discharges the spent cooling air through the film cooling holes. This direct impingement plus film cooling technique provides the most effective way to utilize the cooling air. A row of in-line compound angled holes with breakouts on the fillet surface will create a good film cooling layer for the airfoil fillet region. A row of film cooling holes inline with the hot gas flow increases the uniformity of the film cooling and insulates the leading edge fillet structure from the passing hot core gas and cools the airfoil leading edge fillet. The compound angled film cooling hole injects cooling air in line with the mainstream flow. This minimizes the cooling loss or degradation of the film and therefore provides a more effective film cooling for the film development and maintenance. The film cooling hole extends the cooling air continuously along the interface of the airfoil leading edge versus endwall location and thus minimizes thermally induced stress by eliminating the discrete cooling hole which caused the film to become separated in the non-cooled area that is characteristic of the prior art vanes. The fillet film cooling holes provide local film cooling all around the leading edge fillet location and thus greatly reduce the local metal temperature and improve the airfoil LCF (low cycle fatigue) capability.

I claim the following:

1. A turbine stator vane comprising:

an airfoil portion with a leading edge, a pressure side wall and a suction side wall;

an endwall extending around the airfoil and having a fillet formed between the airfoil walls and the leading edge and the endwall;

a row of film cooling holes opening onto the fillet in the leading edge region of the fillet;

the row of film cooling holes being connected to a cooling air supply cavity of the stator vane so that film cooling air is discharged into the fillet; and the row of film cooling holes are directed to discharge cooling air tangential to a surface of the fillet and towards the airfoil surface.

2. The turbine stator vane of claim 1, and further comprising:

the row of film cooling holes extends around the leading edge fillet and along the pressure side wall fillet.

3. The turbine stator vane of claim 2, and further comprising:

the row of film cooling holes extends around the leading edge fillet and along the suction side wall fillet.

4. The turbine stator vane of claim 1, and further comprising:

the row of film cooling holes each open into a breakout hole that opens into the fillet.

5. The turbine stator vane of claim 4, and further comprising:

the breakout holes are located at about a mid-point of the fillet height from the endwall surface to the airfoil surface.

6. The turbine stator vane of claim 4, and further comprising:

the film cooling holes in the fillet are straight holes with an axis substantially aligned with a curvature of the breakout hole.

7. The turbine stator vane of claim 6, and further comprising:

the film cooling holes is slanted at around 45 degrees to the endwall outer surface.

8. The turbine stator vane of claim 4, and further comprising:

the breakout holes are evenly spaced around the fillet of the stator vane.

9. The turbine stator vane of claim 1, and further comprising:

the film cooling holes are located in the leading edge fillets of the inner endwall and the outer endwall of the stator vane.

10. The turbine stator vane of claim 1, and further comprising:

an impingement plate with impingement holes is positioned on the endwall to provide impingement cooling air to the endwall with the spent impingement cooling air then being used as film cooling air for the film holes in the fillet.

11. The turbine stator vane of claim 1, and further comprising:

the airfoil includes a row of film cooling holes on the pressure side wall just above the fillet.

12. The turbine stator vane of claim 1, and further comprising:

the endwall includes a row of film cooling holes located on the suction side and adjacent to the fillet.

* * * * *